US005890947A

United States Patent [19]

Tanaka et al.

[11] Patent Number: 5,890,947

[45] Date of Patent: Apr. 6, 1999

[54] DRIVE UNIT AND TOY USING SAME

[75] Inventors: Akihiro Tanaka; Kenji Kaneko; Masamitsu Kawano; Toshiaki Nagano; Shinji Ohashi, all of Tochigi, Japan

[73] Assignee: Kabushiki Kaisha Megahouse, Japan

[21] Appl. No.: 669,221

[22] Filed: Jun. 24, 1996

[30] Foreign Application Priority Data

Mar. 29, 1996 [JP] Japan ..... 8-103316

[51] Int. Cl.[6] ..... A63H 33/26

[52] U.S. Cl. ..... 446/298; 84/102

[58] Field of Search ..... 446/298; 310/261; 84/102

[56] References Cited

U.S. PATENT DOCUMENTS 1,921,841 8/1933 Roberts ..... 310/261 X 5,587,545 12/1996 Nakada et al. ..... 84/600

*Primary Examiner*—William H. Grieb

*Attorney, Agent, or Firm*—Graham & James LLP

[57] ABSTRACT

A drive unit and a toy using the same wherein a mechanical drive transmitting mechanism is not used and moving parts are made to pivot by means of magnetic interaction forces acting between coils and magnets and the response of the moving parts is quick and movements of the moving parts can be controlled accurately and subtly, and wherein fatiguing of the coil wires is prevented by the coil parts being fixed and the permanent magnets being made to move. By the drive unit being simplified and reduced in size, a drive unit and a toy using the same which can operate stably over a long period are provided while mass production benefits and cost reductions together with simplification of the manufacturing process are promoted.

In the drive unit, a swinging body 21 is mounted on a swing shaft 20 and a pair of permanent magnets 26, 27 are mounted on the swinging body 21 side by side in the direction in which the swinging body 21 pivots. A yoke 28 is disposed extending across the pair of permanent magnets 26, 27 and a coil 46 is mounted in a position such that it magnetically interacts with the pair of permanent magnets 26, 27 and as a result the swinging body 21 is caused to pivot by a magnetic interaction force acting between the pair of permanent magnets 26, 27 and the coil 46.

18 Claims, 7 Drawing Sheets

DRIVE UNIT AND TOY USING SAME

CROSS-REFERENCE TO RELATED APPLICATIONS

This application is related to U.S. patent application Ser. No. 08/389,351, filed Feb. 16, 1995, now U.S. Pat. No. 5,587,545 entitled MUSICAL TOY, Takashi Nakada et al. inventors. This application is assigned to the same assignee as the present application.

BACKGROUND OF THE INVENTION

1. Field of the Invention

This invention relates to a drive unit for causing a swinging body to pivot by means of a magnetic interaction force acting between a coil and a permanent magnet and a toy in which this drive unit is used.

2. Description of the Related Art

Toys having moving parts to get the attention of those nearby using various drive units have been proposed. In conventional toys of this kind, for example when a coin is inserted, moving parts are moved by the rotary drive of a motor and the toy is thereby made to perform a predetermined action. That is, a conventional toy has a drive transmitting mechanism for reducing in speed and transmitting the rotary drive of a motor with gears or the like, and the rotary drive is mechanically transmitted to specific parts by means of this drive transmitting mechanism and causes those parts to swing or move in some other way.

However, because conventional drive units and toys in which they are used have been constructed so that specific parts are caused to pivot or move in some other way by the rotary drive of a motor being mechanically transmitted to those parts by means of a drive transmitting mechanism, it has been difficult to make the response of the moving parts quick.

Also, there has been the problem that when an attempt is made to control the movements of the moving parts accurately and subtly, the drive transmitting mechanism becomes complex, and not only does the size of the toy itself increase correspondingly but also the work of assembling the toy becomes intricate and complicated.

Furthermore, when gears and cams and the like are used as a drive transmitting mechanism for transmitting the rotary drive of a motor, mechanical drive noises are sometimes produced, and there has been the problem that particularly in quiet environments these mechanical drive noises can be grating and uncomfortable to listen to.

SUMMARY OF THE INVENTION

This invention was devised in view of these problems, and an object of the invention is to realize a drive unit wherein a mechanical drive transmitting mechanism is not used and moving parts are made to pivot by means of magnetic interaction forces acting between a coil and magnets and the response of the moving parts is quick and movements of the moving parts can be controlled accurately and subtly, and by fixing the coil part and making the permanent magnets move provide a drive unit in which fatiguing of the coil wires can be certainly prevented.

Another object of the invention is to provide a drive unit and a toy using the same which can operate stably over a long period while promoting mass production benefits and cost reductions together with simplification of the manufacturing process by reducing the size of the drive unit.

To achieve the above objects and other objects, a drive unit of the present invention includes a swing shaft, a swinging body pivotally mounted on the swing shaft and a pair of permanent magnets mounted on the swinging body side by side as seen in the direction of the swing shaft. A coil is fixed in a position such that it magnetically interacts with the pair of permanent magnets causing the swinging body to pivot by a magnetic interaction force acting between the pair of permanent magnets and the coil.

The drive unit may further include a yoke disposed extending across the pair of permanent magnets. The yoke may be disposed on surfaces of the pair of permanent magnets and on the opposite side of the permanent magnets from the coil, allowing the magnetic interaction force acting between the pair of permanent magnets and the coil to be made large. Alternatively, the yoke may be disposed between the pair of permanent magnets.

It is thus possible to realize a drive unit wherein a mechanical drive transmitting mechanism is not used and moving parts are made to pivot by means of magnetic interaction forces acting between a coil and magnets and the response of the moving parts is quick and movements of the moving parts can be controlled accurately and subtly. Also, by fixing the coil part and making the permanent magnets move, fatiguing of the coil wires can be prevented.

Also, because the drive unit can be simplified and reduced in size, it is possible to realize a drive unit which can operate stably over a long period while promoting mass production benefits and cost reductions together with simplification of the manufacturing process.

The drive unit may further include a music signal generating means for generating a music signal. An exciting signal supplying means is provided for supplying an exciting signal to the coil according to the music signal. Thus, it is possible to make the drive unit execute a musical performance according to the music signal.

The drive unit may further include a magnetic body disposed in a position such that it magnetically interacts with the pair of permanent magnets, forcing the swinging body to pivot to an initial position by a magnetic interaction force acting between the magnetic body and the pair of permanent magnets. Preferably, the magnetic interaction force acting between the magnetic body and the pair of permanent magnets is set smaller than the magnetic interaction force acting between the coil and the pair of permanent magnets.

To achieve the above and other objects, a toy in accordance with this invention includes a doll body, a swing shaft mounted in the doll body and a swinging body pivotally mounted on the swing shaft. A pair of permanent magnets are mounted on the swinging body side by side as seen in the direction of the swing shaft. A yoke is disposed extending across the pair of permanent magnets and a coil is fixed in a position such that it magnetically interacts with the pair of permanent magnets causing the swinging body to pivot by a magnetic interaction force acting between the pair of permanent magnets and the coil. An arm of the doll body is removably attached to the swinging body and swings in linkage with the swinging body. Further, a tapper is mounted on the arm and as a result a sound producing body is struck by the tapper. A base may also be provided and may be disposed in a position such that it is struck by the tapper; thus, the sound producing body can be dispensed with making it possible to promote cost reductions.

The toy may further include a magnetic body mounted in the doll body in a position such that it magnetically interacts with a pair of permanent magnets, causing the swinging body to forcibly pivot to an initial position by a magnetic interaction force acting between the magnetic body and the pair of permanent magnets. Also, the coil may be mounted in the doll body. Preferably, the magnetic interaction force acting between the magnetic body and the pair of permanent magnets is set smaller than the magnetic interaction force acting between the coil and the pair of permanent magnets.

The doll body may be removably connected to the base, and may further include music signal generating means for generating a music signal and exciting signal supplying means for supplying an exciting signal to the coil according to the music signal. Thus, the musical toy can be made to execute a musical performance according to the music signal. Alternatively, the base may include the music signal generating means for generating a music signal and the exciting signal supplying means for supplying an exciting signal to the coil according to the music signal.

Consequently, it is possible to realize a drive unit wherein a mechanical drive transmitting mechanism is not used and moving parts are made to pivot by means of magnetic interaction forces acting between a coil and magnets and the response of the moving parts is quick and movements of the moving parts can be controlled accurately and subtly. Also, by fixing the coil part and making the permanent magnets move, fatiguing of the coil wires can be prevented. Also, because the drive unit can be simplified and reduced in size, it is possible to realize a toy which can operate stably over a long period while promoting mass production benefits and cost reductions together with simplification of the manufacturing process.

DESCRIPTION OF THE PREFERRED EMBODIMENTS

Preferred embodiments of the invention will now be described with reference to the accompanying drawings.

Figure 1:
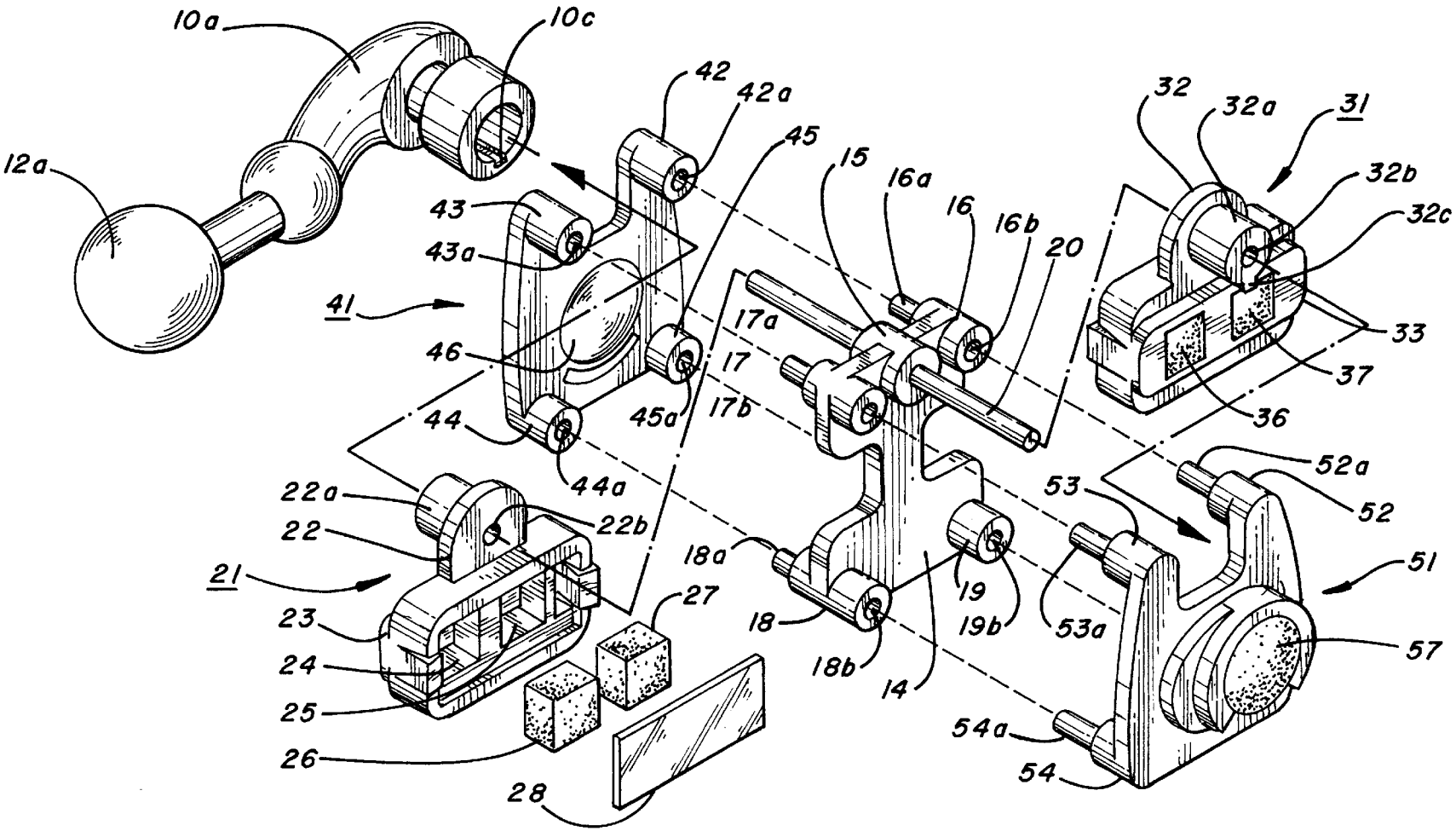
FIG. 1 is an exploded perspective view of a main part of a drive unit according to the invention.
Figure 2:
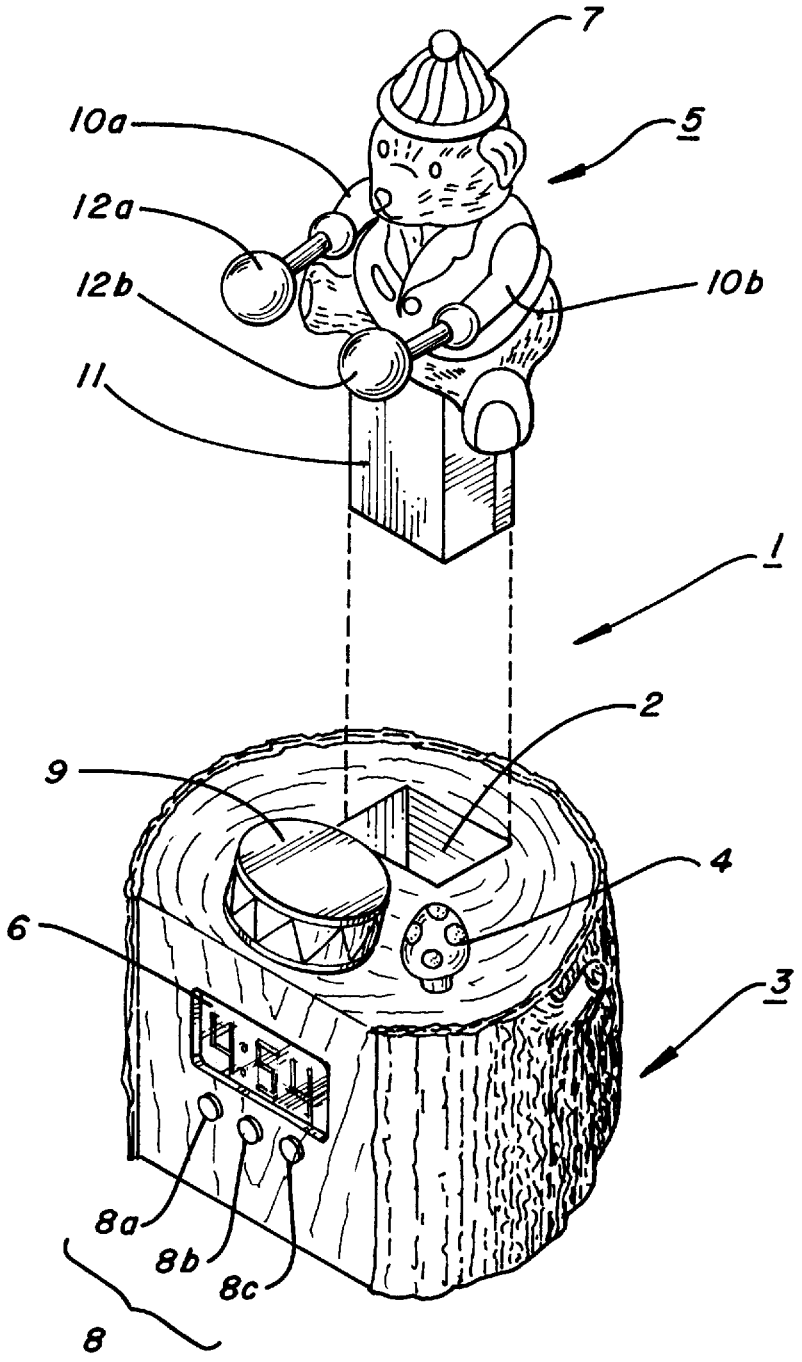
FIG. 2 is an exterior perspective view of a toy according to the invention.
Figure 3:
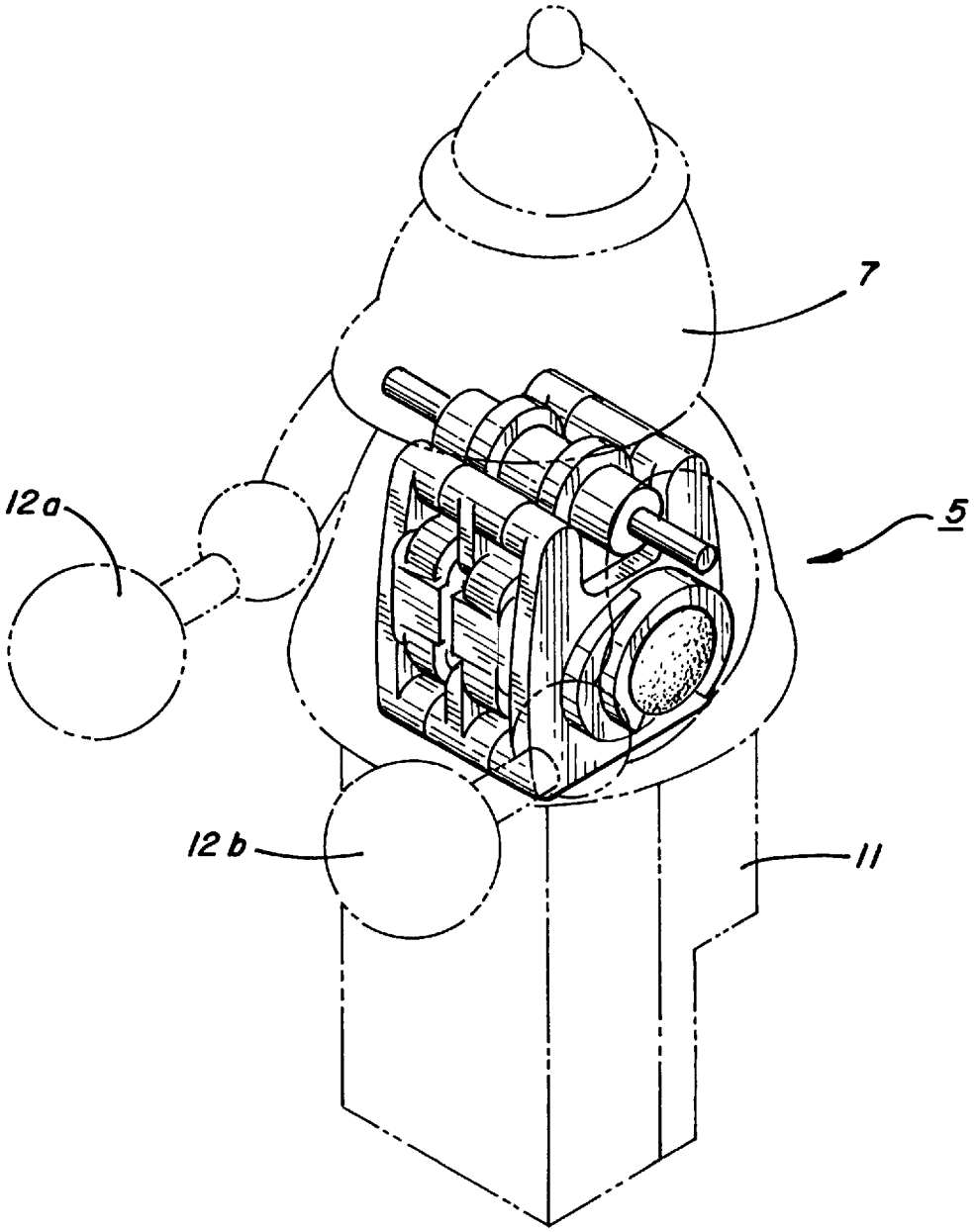
FIG. 3 is a front perspective view of a doll body shown in FIG. 2.
Figure 4:
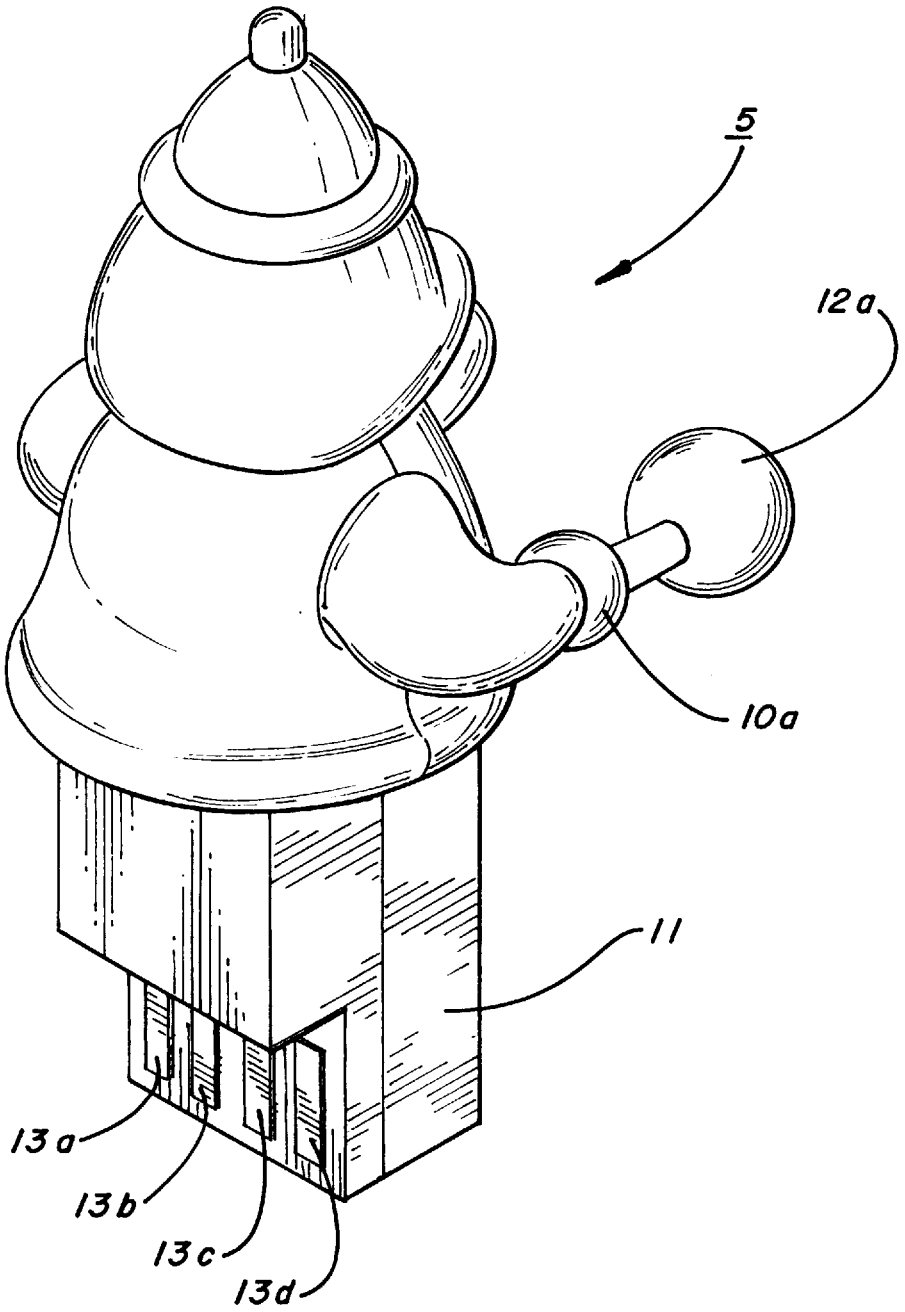
FIG. 4 is a rear perspective view of the doll body shown in FIG. 2.

FIG. 1 is an exploded perspective view of a main part of a drive unit according to the invention, FIG. 2 is an exterior perspective view of a toy in which a drive unit according to the invention is used, FIG. 3 is a front perspective view of a doll body according to the invention and FIG. 4 is a rear perspective view of a doll body according to the invention.

First, explaining the construction, and referring to FIG. 2, a toy 1 according to the invention comprises a base 3 having a circuit part and a doll body 5 removably connected to the base 3. A torso portion of the doll body 5, which contains a drive unit, is made of a suitable material such as synthetic resin, and a head portion 7 is removably or permanently attached to the top of the torso portion. Also, a sound producing body 9 having a suitable shape such as that of a drum, a tree stump or a bone is mounted on the base 3. A mounting portion 2 for mounting the doll body 5 to and an on-off switch 4 are provided in the vicinity of the sound producing body 9. A display 6 for displaying the present time and an alarm time and the like and an operating part 8 are provided in a front face of the base 3. The operating part 8 consists of a plurality of switches 8*a*, 8*b* and 8*c* and can be used to set a present time display mode, an alarm setting mode and a timer setting mode and the like.

Arms 10*a*, 10*b* are removably attached to the doll body 5, and tappers 12*a*, 12*b* are mounted on the ends of the arms 10*a*, 10*b* respectively. The above-mentioned sound producing body 9 is struck by these tappers 12*a*, 12*b*. A mounting portion 11 is formed on the bottom of the doll body 5, connectors 13*a*, 13*b*, 13*c* and 13*d* (FIG. 4) are disposed on the mounting portion 11 and when the doll body 5 is mounted on the base 3 the circuit part in the base 3 and the drive unit in the doll body 5 are electrically connected by the connectors 13*a*, 13*b*, 13*c* and 13*d*.

Next, the internal construction of the doll body 5 as shown in FIG. 1 will be described.

A partition plate 14 is disposed in a substantially central portion of the doll body 5. Boss portions 15, 16, 17, 18 and 19 are provided projecting from both sides of the partition plate 14. A through hole is provided in the boss portion 15, and a swing shaft 20 passes through this through hole. Shafts 16*a*, 17*a*, 18*a*, . . . are embedded in the parts of the boss portions 16, 17, 18 and 19 projecting from one side of the partition plate 14. Holes 16*b*, 17*b*, 18*b* and 19*b* are provided in positions opposite these, i.e. in the parts of the boss portions 16, 17, 18 and 19 projecting from the other side of the partition plate 14.

A pair of swinging bodies 21, 31 are mounted on the swing shaft 20 disposed passing through the partition plate 14. That is, a swinging body 21 is mounted on the left side of the partition plate 14 shown in FIG. 1, and an swinging body 31 is mounted on the right side of the partition plate 14.

The swinging body 21 is made up of an attaching portion 22 and a frame portion 23 formed integrally. A boss portion 22*a* is provided on the left side face of the attaching portion 22, and a through hole 22*b* passes through this boss portion 22*a*. The leftward portion of the above-mentioned swing shaft 20 passes through this through hole 22*b*. Also, a mating projection mating with a mating recess 10*c* on the arm 10*a* is provided on the outside of the boss portion 22*a*. The arm 10*a* of the doll body 5 is removably attached to the swinging body 21 by the boss portion 22*a* and this mating projection and swings together with the swinging body 21.

Windows 24, 25 are provided in the frame portion 23, and a pair of permanent magnets 26, 27 are mounted in the windows 24, 25. This pair of permanent magnets 26, 27 are lined up in the direction in which the swinging body 21 pivots. That is, the pair of permanent magnets 26, 27 are disposed side by side in the plane in which the swinging body 21 pivots and on the left and right of the swing shaft 20. Also, a yoke 28 is disposed covering the right side surfaces of the pair of permanent magnets 26, 27, i.e. extending across the pair of permanent magnets 26, 27. The yoke 28 is made of a suitable magnetic material such as soft iron or carbon steel, and forms a magnetic path between the permanent magnets 26 and 27. By the yoke 28 being interposed between the permanent magnets 26 and 27 in this way, a magnetic interaction force acting between the pair of permanent magnets 26, 27 and a coil 46 is made large.

Similarly, the swinging body 31 is made up of an attaching portion 32 and a frame portion 33 formed integrally. A boss portion 32*a* is provided on the right side face of the attaching portion 32, and a through hole 32*b* passes through this boss portion 32*a*. The above-mentioned swing shaft 20 passes through this through hole 32*b*. Also, a mating projection 32*c* mating with a mating recess (not shown) in the arm 10*b* is provided on the outside of the boss portion 32*a*. The arm 10*b* of the doll body 5 is removably attached to the swinging body 31 by the boss portion 32*a* and the mating projection 32*c* and swings together with the swinging body 31.

Windows are provided in the frame portion 33, and a pair of permanent magnets 36, 37 are mounted in these windows. This pair of permanent magnets 36, 37 are lined up in the direction in which the swinging body 31 pivots. That is, the pair of permanent magnets 36, 37 are disposed side by side in the plane in which the swinging body 31 pivots and on the left and right of the swing shaft 20. Also, a yoke 38 (see FIG. 6) is disposed extending across the pair of permanent magnets 36, 37. The yoke 38 is made of a suitable magnetic material such as soft iron or carbon steel, and forms a magnetic path between the permanent magnets 36 and 37. By the yoke 38 being interposed between the permanent magnets 36 and 37 in this way, a magnetic interaction force acting between the pair of permanent magnets 36, 37 and a coil 56 (see FIG. 6) is made large.

Figure 10:
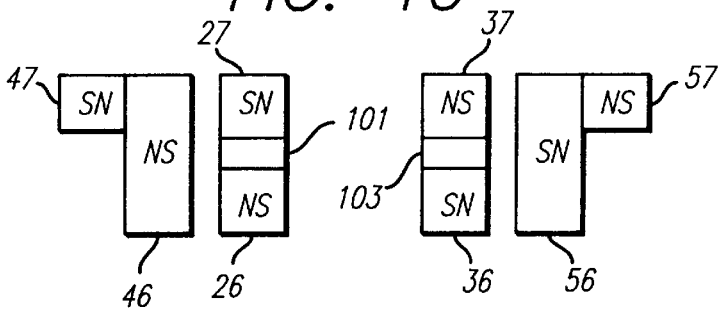
FIG. 10 is a view schematically illustrating coils, permanent magnets and their vicinity.

As shown in FIG. 10, alternatively a yoke 101 may be disposed in a gap between the permanent magnets 26 and 27 and similarly a yoke 103 may be disposed in a gap between the permanent magnets 36 and 37. Also, the frame portion 23 and the frame portion 33 themselves may be made of a suitable magnetic material such as soft iron or carbon steel.

A fixed plate 41 (FIG. 1) is disposed facing the swinging body 21 and a fixed plate 51 is disposed facing the swinging body 31.

A plurality of boss portions 42, 43, 44 and 45 are provided on the right side face of the fixed plate 41. Holes 42*a*, 43*a*, 44*a* and 45*a* are formed in these boss portions 42, 43, 44 and 45. The above-mentioned shafts 16*a*, 17*a*, 18*a*, . . . are inserted into these holes 42*a*, 43*a*, 44*a* and 45*a*, and the fixed plate 41 is thereby fixed to the partition plate 14. A coil 46 is mounted in a substantially central part of the fixed plate 41. Also, a permanent magnet 47 (not shown in FIG. 1 but see FIG. 6) serving as a magnetic body is disposed on the coil 46 in a position such that it faces the permanent magnet 27. The coil 46 and the permanent magnet 47 are disposed in positions such that they magnetically interact with the pair of permanent magnets 26, 27. By magnetically interacting with the pair of permanent magnets 26, 27, this permanent magnet 47 forcibly causes the swinging body 21 to pivot to an initial position. Here, the magnetic interaction force acting between the permanent magnet 47 serving as the magnetic body and the pair of permanent magnets 26, 27 is set smaller than the magnetic interaction force acting between the excited coil 46 and the pair of permanent magnets 26, 27, and as a result the swinging body 21 is caused to pivot from the initial position to a tapping position by the magnetic interaction force acting between the pair of permanent magnets 26, 27 and the excited coil 46.

Also, a plurality of boss portions 52, 53, 54, . . . are provided on the left side face of the fixed plate 51. Shafts 52*a*, 53*a*, 54*a*, . . . are embedded in these boss portions 52, 53, 54, . . . . These shafts 52*a*, 53*a*, 54*a*, . . . are inserted into the above-mentioned holes 16*b*, 17*b*, 18*b*, . . . and the fixed plate 51 is thereby fixed to the partition plate 14. A coil 56 (not shown in FIG. 1 but see FIG. 6) is mounted in a substantially central part of the fixed plate 51. Also, a permanent magnet 57 serving as a magnetic body is disposed on the coil 56 in a position such that it faces the permanent magnet 37. The coil 56 and the permanent magnet 57 are disposed in positions such that they magnetically interact with the pair of permanent magnets 36, 37. By magnetically interacting with the pair of permanent magnets 36, 37, this permanent magnet 57 forcibly causes the swinging body 31 to pivot to an initial position. Here, the magnetic interaction force acting between the permanent magnet 57 serving as the magnetic body and the pair of permanent magnets 36, 37 is set smaller than the magnetic interaction force acting between the excited coil 56 and the pair of permanent magnets 36, 37, and as a result the swinging body 31 is caused to pivot from the initial position to a tapping position by the magnetic interaction force acting between the pair of permanent magnets 36, 37 and the excited coil 56.

Figure 5:
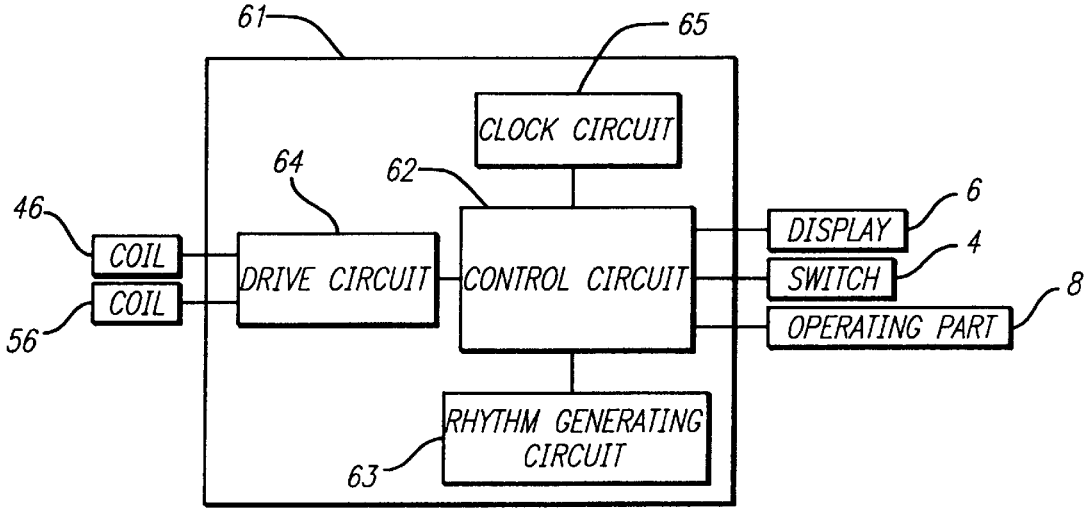
FIG. 5 is a circuit diagram of a circuit for operating a drive unit according to the invention.

The circuit construction of the circuit part mounted inside the base 3) and its peripherals will now be described with reference to FIG. 5.

A control device 61 consists of one integrated circuit. This control device 61 is made up of a control circuit 62, a rhythm generating circuit 63, a drive circuit 64 and a clock circuit 65. The control circuit 62 has a processor such as a microcomputer (CPU) and memory such as ROM and RAM, and executes various arithmetic processing. The rhythm generating circuit 63 is signal generating means for generating a music signal and has a memory part in which music signals are stored and a readout part for reading out a music signal from the memory part. The control circuit 62 controls the rhythm generating circuit 63 and generates a rhythm drive signal on the basis of a signal from the rhythm generating circuit 63. The drive circuit 64 is connected to the control circuit 62 and is also connected to the pair of coils 46, 56. The control circuit 62 and the drive circuit 64 together constitute exciting signal supplying means and supply an exciting signal to the coils 46, 56 according to the above-mentioned music signal. That is, the drive circuit 64 supplies an exciting signal of the kind shown in FIG. 7 made up of pulses according to a signal from the control circuit 62. The clock circuit 65 outputs a clock pulse and present time information and the like to the control circuit 62 and also outputs clock information such as an elapsed time from a present time to the control circuit 62.

The display 6 is connected to the control circuit 62 and displays the present time or an alarm time or the like according to a signal from the control circuit 62. The switch 4 and the operating part 8 are also connected to the control circuit 62. The operating part 8 has a plurality of switches 8*a*, 8*b* and 8*c*, and by suitably operating these switches 8*a*, 8*b* and 8*c* it is possible to set the present time and an alarm time and so on.

A toy 1 according to the invention has an 'alarm performance mode', a 'time report performance mode' and a 'demo performance mode', and by operating the operating part 8 or the switch 4 it is possible to suitably set the toy 1 to one of these modes. When one of these various performance functions is set the control circuit 62 executes musical performance control processing corresponding to this. For example, when the 'alarm performance mode' is set, the control circuit 62 starts a musical performance operation when an alarm time is reached; when the 'time report performance mode' is set, the control circuit 62 starts a musical performance once every hour, exactly on the hour; and when the 'demo performance mode' is set, a performance can be started at any time by operating the switch 4.

In the preferred embodiment described above, the control device 61 is mounted inside the base 3; however, the invention is not limited to this, and the control device 61 can alternatively be mounted inside the doll body 5 in some suitable position such as for example on the partition plate 14 or inside the mounting portion 11. By selling this kind of doll body on its own, it is possible to reduce cost further. In this case, it is possible to play by having the tappers of the doll body strike a suitable sound producing body such as a desk top or a metal object.

Also, although in the preferred embodiment shown in FIG. 2 one sound producing body 9 struck by the tappers 12*a*, 12*b* is provided, a sound producing body struck by the tapper 12*a* and a sound producing body struck by the tapper 12*b* may alternatively be provided separately. Or a construction may be adopted wherein the kind of special sound producing body described above is dispensed with and the tappers 12*a*, 12*b* strike the upper surface of the base 3. When the sound producing body is dispensed with like this, it is possible to further reduce the cost of the toy.

Also, although in the preferred embodiment described above a permanent magnet 47 serving as a magnetic body is disposed in a position such that it magnetically interacts with the pair of permanent magnets 26, 27 and a permanent magnet 57 serving as a magnetic body is disposed in a position such that it magnetically interacts with the pair of permanent magnets 36, 37, other suitable magnetic bodies such as rivets may be used as the magnetic bodies for causing the swinging bodies 21, 31 to pivot to initial positions by means of magnetic interaction forces acting between themselves and the pairs of permanent magnets. That is, a rivet serving as a magnetic body may be disposed in a position such that it magnetically interacts with the pair of permanent magnets 26, 27 and a rivet serving as a magnetic body may be disposed in a position such that it magnetically interacts with the pair of permanent magnets 36, 37.

Next, the operation of the preferred embodiment of the invention described above will be described with reference to FIG. 6 through FIG. 8.

First, an initial state of rest wherein no exciting signal is fed to the coils 46, 56 will be described.

For example, the side of the permanent magnet 26 facing the yoke 28 is set to magnetic pole S and the side facing the coil 46 is set to magnetic pole N. the side of the permanent magnet 27 facing the yoke 28 is set to magnetic pole N and the side facing the coil 46 is set to magnetic pole S, the side of the permanent magnet 47 facing the coil 46 is set to magnetic pole N and the other side is set to magnetic pole S. Similarly, the side of the permanent magnet 36 facing the yoke 38 is set to magnetic pole S and the side facing the coil 56 is set to magnetic pole N, the side of the permanent magnet 37 facing the yoke 38 is set to magnetic pole N and the side facing the coil 56 is set to magnetic pole S, and the side of the permanent magnet 57 facing the coil 56 is set to magnetic pole N and the other side is set to magnetic pole S.

Under the set conditions described above, the arm 10*a* is caused to swing upward by a magnetic interaction force acting between the pair of permanent magnets 26, 27 and the permanent magnet 47 and the arm 10*b* is caused to swing upward by a magnetic interaction force acting between the pair of permanent magnets 36, 37 and the permanent magnet 57. As a result, the tappers 12*a*, 12*b* mounted on the ends of the two arms 10*a*, 10*b* are at rest in initial positions above the sound producing body 9.

Musical performance operation will now be described.

The control circuit 62 (FIG. 5) inputs a clock pulse of a predetermined period from the clock circuit 65 and inputs a music signal from the rhythm generating circuit 63, and generates an exciting signal by controlling the output timing of the clock pulse according to this music signal. This exciting signal is fed through the drive circuit 64 to the coils 46, 56.

Figure 7:
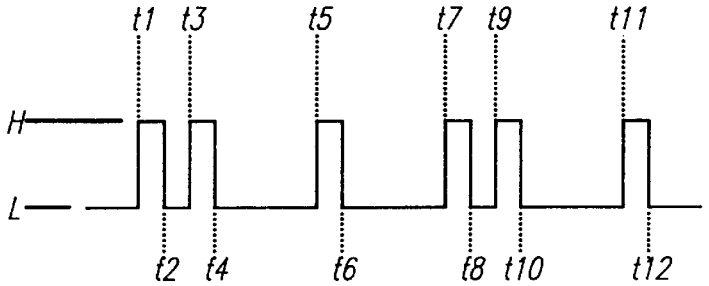
FIG. 7 is a signal waveform of an exciting signal supplied to a coil.

For example, a pulse signal of the kind shown in FIG. 7 is supplied to the coil 46 as an exciting signal.

Figure 6:
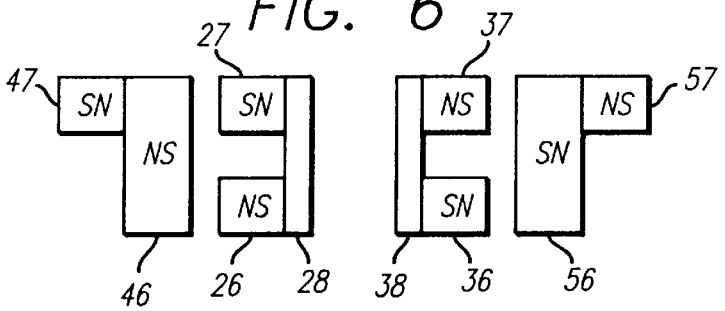
FIG. 6 is a view schematically illustrating coils and permanent magnets.

When an positive pulse is output to the coil 46 at time ti, magnetic poles form at the sides of the coil 46 according to the direction of the current flowing through the coil 46. Here, supposing for example that as shown in FIG. 6 a magnetic pole S forms on the right side of the coil 46, i.e. the side facing the pair of permanent magnets 26, 27, the magnetic pole S of the coil 46 and the magnetic pole N of the permanent magnet 26 mutually attract and the magnetic pole S of the coil 46 and the magnetic pole S of the permanent magnet 27 mutually repel. As a result, the swinging body 21 pivots so as to swing the arm 10*a* downward and the tapper 12*a* strikes the sound producing body 9.

Next, when at time t2 the pulse signal falls to an L level, the current flowing through the coil 46 stops and consequently the magnetic poles of the coil 46 cease to exist. As a result, the state becomes the same as the initial state wherein no exciting signal is supplied to the coil 46 and the arm 10*a* is swung upward.

Similarly thereafter, the operation described above is repeated. Therefore, every time the pulse signal rises from the L level to an H level, the corresponding tapper strikes the sound producing body and produces a sound.

The musical performance described above is the same in a case where an exciting signal is fed to the coil 56; the arms 10*a*, 10*b* each operate independently, and by the pair of arms 10*a*, 10*b* swinging the toy executes a musical performance operation.

Of course, by adjusting the pulse width and the timing of the pulse signal fed from the control device 61 it is possible to produce suitable subtle rhythm sounds.

Also, by generating the pulse signal fed to the coils 46, 56 according to suitable rhythm sounds it is possible to make the toy produce any subtle rhythm sound certainly and easily and the toy can thereby be made interesting.

Figure 8:
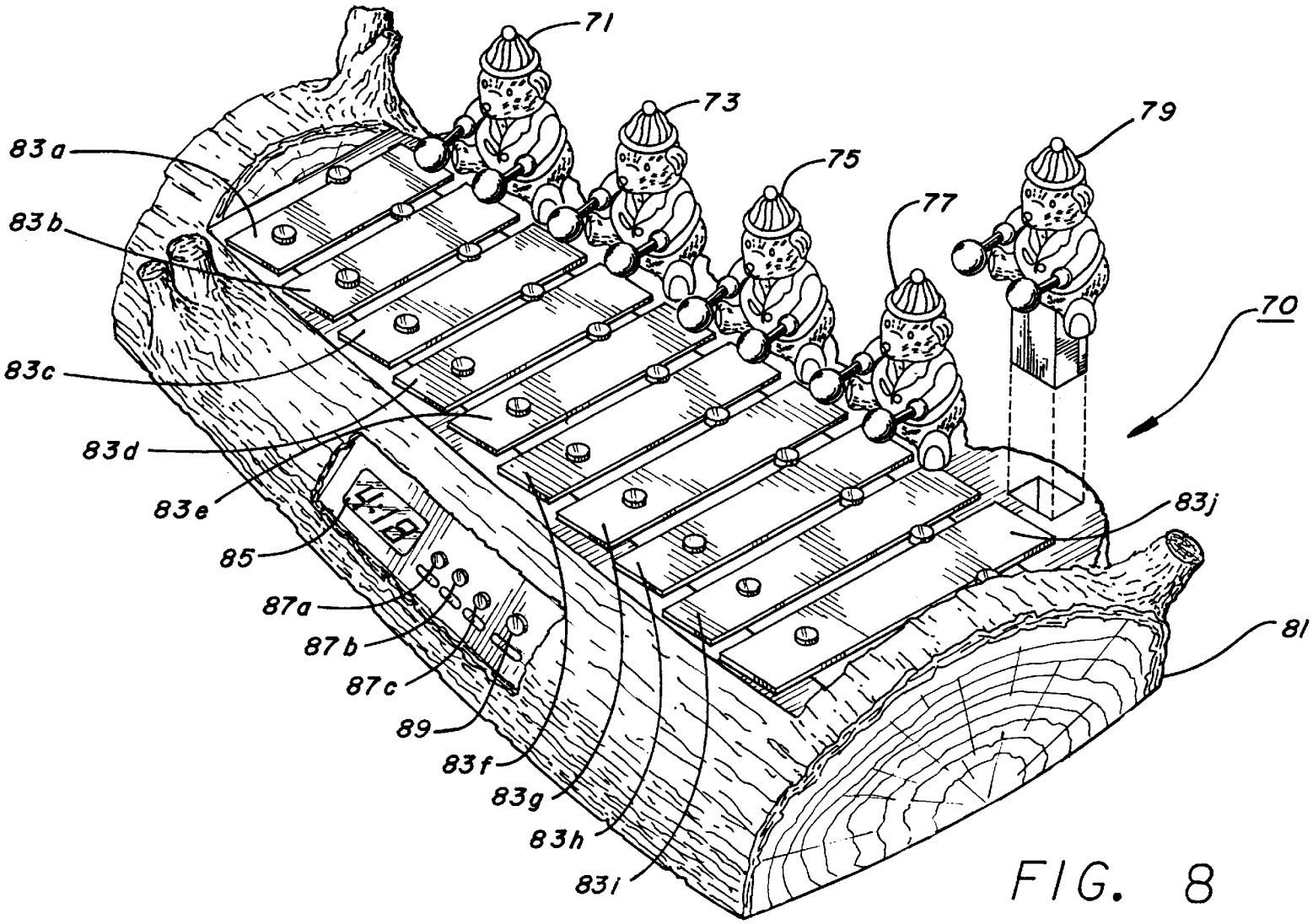
FIG. 8 is a perspective view of the exterior of another preferred embodiment of the invention.

Another preferred embodiment of the invention will now be described with reference to FIG. 8.

A toy 70 of this preferred embodiment is characterized in that a plurality of doll bodies 71, 73, 75, 77 and 79 are used to enable the toy to per-form melodies.

The plurality of doll bodies 71, 73, 75, 77 and 79 are removably mounted on a base 81 and 10 sound producing bodies 83*a*, 83*b*, 83*c*, . . . 83*j* of different musical notes are disposed in the middle of the base 81. Two sound producing bodies are allocated to each of the doll bodies 71, 73, 75, 77 and 79. Also, a display 85 and a plurality of switches 87*a*, 87*b*, 87c and 89 are provided on a front face of the base 81.

Inside the base 81 there are provided music signal generating means for generating a melody signal as a music signal and exciting signal supplying means for supplying exciting signals to coils of the doll bodies according to the melody signal.

Arms of respective doll bodies swing according to the melody signal, tappers thereon sequentially strike their respective sound producing bodies and the toy can thereby perform a melody.

Figure 9:
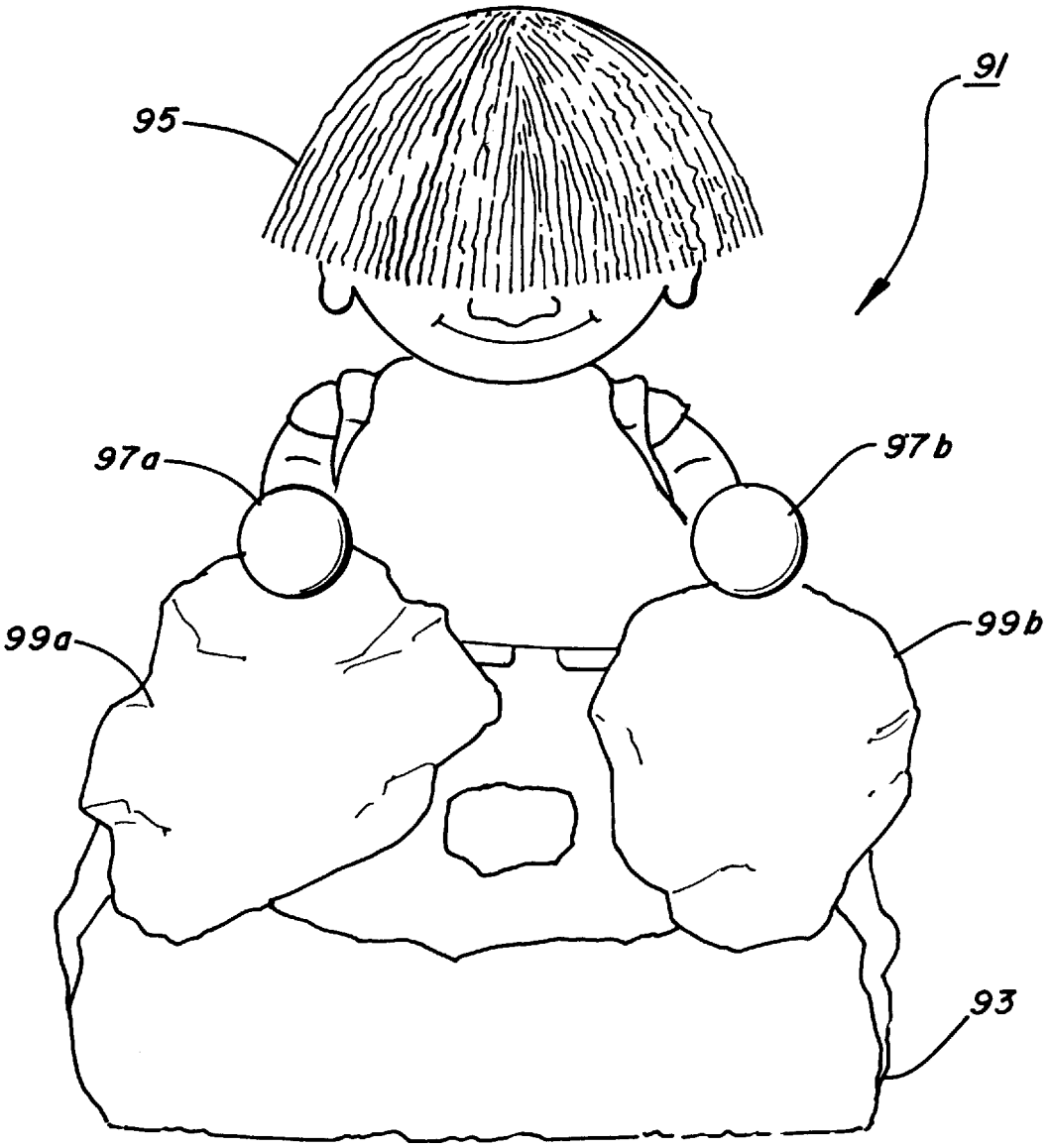
FIG. 9 is an exterior perspective view of another preferred embodiment of the invention.

Another preferred embodiment of the invention will now be described with reference to FIG. 9.

A toy 91 of this preferred embodiment is characterized in that a doll body 95 is permanently fixed to a base 93. A sound producing body 99*a* struck by a tapper 97*a* and a sound producing body 99*b* struck by a tapper 97*b* are disposed on the base 93.

By the doll body 95 being permanently fixed to the base 93 like this it is possible to dispense with connectors between the base 93 and the doll body 95 and therefore it is possible to promote further reduction of the cost of the toy.

In accordance with the embodiments described above, the following modes for practicing this invention are provided. According to the drive unit of the first mode provided by the invention, there is provided a swing shaft, a swinging body is pivotally mounted on the swing shaft and a pair of permanent magnets are mounted on the swinging body side by side as seen in the direction of the swing shaft. A yoke is disposed extending across the pair of permanent magnets and a coil is fixed in a position such that it magnetically interacts with the pair of permanent magnets and as a result the swinging body is caused to pivot by a magnetic interaction force acting between the pair of permanent magnets and the coil.

According to the drive unit of the second mode provided by the invention, there is provided a swing shaft, a swinging body is pivotally mounted on the swing shaft and a pair of permanent magnets are mounted on the swinging body side by side as seen in the direction of the swing shaft. A yoke is disposed between the pair of permanent magnets and a coil is fixed in a position such that it magnetically interacts with the pair of permanent magnets and as a result the swinging body is caused to pivot by a magnetic interaction force acting between the pair of permanent magnets and the coil.

According to the drive unit of the third mode provided by the invention, there is provided a swing shaft, a swinging body is pivotally mounted on the swing shaft and a pair of permanent magnets are mounted on the swinging body side by side as seen in the direction of the swing shaft. A yoke is disposed extending across the pair of permanent magnets and a coil is fixed in a position such that it magnetically interacts with the pair of permanent magnets and as a result the swinging body is caused to pivot by a magnetic interaction force acting between the pair of permanent magnets and the coil. Because the yoke is disposed on surfaces of the pair of permanent magnets and on the opposite side of the permanent magnets from the coil, there is the benefit in the third mode that the magnetic interaction force acting between the pair of permanent magnets and the coil can be made large.

According to the drive unit of the fourth mode provided by the invention, there is provided a swing shaft, a swinging body is pivotally mounted on the swing shaft and a pair of permanent magnets are mounted on the swinging body side by side as seen in the direction of the swing shaft. A magnetic body is disposed in a position such that it magnetically interacts with the pair of permanent magnets and the swinging body is forcibly caused to pivot to an initial position by a magnetic interaction force acting between the magnetic body and the pair of permanent magnets. A yoke is disposed extending across the pair of permanent magnets and a coil is fixed in a position such that it magnetically interacts with the pair of permanent magnets. The magnetic interaction force acting between the magnetic body and the pair of permanent magnets is set smaller than the magnetic interaction force acting between the coil and the pair of permanent magnets, and as a result the swinging body is caused to pivot by the magnetic interaction force acting between the pair of permanent magnets and the coil. Because a magnetic body is disposed in a position such that it magnetically interacts with the pair of permanent magnets, there is the benefit in the fourth mode that the swinging body can be forcibly caused to pivot to an initial position.

According to the drive unit of the fifth mode provided by the invention, there is provided a swing shaft, a swinging body is pivotally mounted on the swing shaft and a pair of permanent magnets are mounted on the swinging body side by side as seen in the direction of the swing shaft. A yoke is disposed extending across the pair of permanent magnets and a coil is fixed in a position such that it magnetically interacts with the pair of permanent magnets and as a result the swinging body is caused to pivot by a magnetic interaction force acting between the pair of permanent magnets and the coil. Because there is provided music signal generating means for generating a music signal and an exciting signal is supplied to the coil according to the music signal, there is the benefit in the fifth mode that it is possible to make the drive unit execute a musical performance according to the music signal.

According to the drive unit of the sixth mode provided by the invention, there is provided a swing shaft, a swinging body is pivotally mounted on the swing shaft and a pair of permanent magnets are mounted on the swinging body side by side as seen in the direction of the swing shaft. A magnetic body is disposed in a position such that it magnetically interacts with the pair of permanent magnets and the swinging body is forcibly caused to pivot to an initial position by a magnetic interaction force acting between the magnetic body and the pair of permanent magnets. A yoke is disposed extending across the pair of permanent magnets and a coil is fixed in a position such that it magnetically interacts with the pair of permanent magnets. The magnetic interaction force acting between the magnetic body and the pair of permanent magnets is set smaller than the magnetic interaction force acting between the coil and the pair of permanent magnets, and as a result the swinging body is caused to pivot by the magnetic interaction force acting between the pair of permanent magnets and the coil. Because a magnetic body is disposed in a position such that it magnetically interacts with the pair of permanent magnets, the swinging body of the sixth mode can be forcibly caused to pivot to an initial position. Moreover, because there is provided music signal generating means for generating a music signal and an exciting signal is supplied to the coil according to the music signal, there is the benefit in the sixth mode that it is possible to make the drive unit execute a musical performance according to the music signal.

In accordance with the first through sixth modes described above, it is possible to realize a drive unit wherein a mechanical drive transmitting mechanism is not used and moving parts are made to pivot by means of magnetic interaction forces acting between the coil and magnets and the response of the moving parts is quick and movements of the moving parts can be controlled accurately and subtly. Also, there is the benefit that by fixing the coil part and making the permanent magnets move, fatiguing of the coil wires can be prevented. Also, there is the benefit that because the drive unit can be simplified and reduced in size it is possible to realize a drive unit which can operate stably over a long period while promoting mass production benefits and cost reductions together with simplification of the manufacturing process.

According to the toy of the seventh mode provided by the invention, there are provided a base and a doll body, a swing shaft is mounted in the doll body, a swinging body is pivotally mounted on the swing shaft and a pair of permanent magnets are mounted on the swinging body side by side as seen in the direction of the swing shaft. A yoke is disposed extending across the pair of permanent magnets and a coil is fixed in a position such that it magnetically interacts with the pair of permanent magnets and as a result the swinging body is caused to pivot by a magnetic interaction force acting between the pair of permanent magnets and the coil. An arm of the doll body is removably attached to the swinging body and a tapper is mounted on the arm and as a result a sound producing body is struck by the tapper.

According to the toy of the eighth mode provided by the invention, there is provided a doll body and a magnetic body mounted in the doll body in a position such that it magnetically interacts with a pair of permanent magnets. Thus, the swinging body can be forcibly caused to pivot to an initial position by a magnetic interaction force acting between the magnetic body and the pair of permanent magnets.

According to the toy of the ninth mode provided by the invention, there is provided a base and a doll body. The doll body has music signal generating means for generating a music signal and has exciting signal supplying means for supplying an exciting signal to the coil according to the music signal. Thus, the toy can be made to execute a musical performance according to the music signal.

According to the toy of the tenth mode provided by the invention, there is provided a doll body and a magnetic body mounted in the doll body in a position such that it magnetically interacts with the pair of permanent magnets. Thus, the swinging body can be forcibly caused to pivot to an initial position by a magnetic interaction force acting between the pair of permanent magnets and the magnetic body. Also, the doll body has music signal generating means for generating a music signal and has exciting signal supplying means for supplying an exciting signal according to this music signal to the coil. Thus, the toy can be made to execute a musical performance according to the music signal.

According to the toy of the eleventh mode provided by the invention, there is provided a base and a doll body removably connected to the base. The base has the music signal generating means for generating a music signal and the exciting signal supplying means for supplying an exciting signal to the coil according to the music signal. Thus, it is possible to simplify the doll body further.

According to the toy of the twelfth mode provided by the invention, there is provided a base and a doll body removably connected to the base. The base has the music signal generating means for generating a music signal and the exciting signal supplying means for supplying an exciting signal to the coil according to the music signal. Thus, it is possible to simplify the doll body further. Moreover, a magnetic body is mounted in the doll body in a position such that it magnetically interacts with the pair of permanent magnets; therefore, there is the benefit that the swinging body can be forcibly caused to pivot to an initial position by a magnetic interaction force acting between the magnetic body and the pair of permanent magnets.

According to the toy of the thirteenth mode provided by the invention, there is provided a base and a doll body removably connected to the base. The base has the music signal generating means for generating a music signal and the exciting signal supplying means for supplying an exciting signal to the coil according to the music signal. Thus, it is possible to simplify the doll body further. Moreover, the base is disposed in a position such that it is struck by the tapper; therefore, there is the benefit that the sound producing body can be dispensed with and it is possible to promote cost reductions.

According to the toy of the fourteenth mode provided by the invention, there is provided a base and a doll body removably connected to the base. The base has the music signal generating means for generating a music signal and the exciting signal supplying means for supplying an exciting signal to the coil according to the music signal. Thus, it is possible to simplify the doll body further. Furthermore, a magnetic body is mounted in the doll body in a position such that it magnetically interacts with the pair of permanent magnets; therefore, the swinging body can be forcibly caused to pivot to an initial position by a magnetic interaction force acting between the magnetic body and the pair of permanent magnets. Moreover, the base is disposed in a position such that it is struck by the tapper; therefore, there is the benefit that the sound producing body can be dispensed with and it is possible to promote cost reductions.

In accordance with the seventh through fourteenth modes as described above, it is possible to realize a drive unit wherein a mechanism is not used and moving parts are made to pivot by means of magnetic interaction forces acting between a coil and magnets and the response of the moving parts is quick and movements of the moving parts can be controlled accurately and subtly. Also, there is the benefit that by fixing the coil part and making the permanent magnets move, fatiguing of the coil wires can be prevented. Furthermore, there is the benefit that because the drive unit can be simplified and reduced in size it is possible to realize a toy which can operate stably over a long period while promoting mass production benefits and cost reductions together with simplification of the manufacturing process.

Thus, it is seen that a drive unit and toy using the same are provided. One skilled in the art will appreciate that the present invention can be practiced by other than the preferred embodiments which are presented for purposes of illustration and not of limitation, and the present invention is limited only by the claims which follow.

What is claimed is:

1. A drive unit comprising:

(a) a swing shaft and a swinging body pivotally mounted on the swing shaft;

(b) a pair of permanent magnets mounted on the swinging body side by side as seen in the direction of the swing shaft;

(c) a yoke disposed between the pair of permanent magnets; and (d) a coil fixed in a position such that it magnetically interacts with the pair of permanent magnets;

(e) wherein the swinging body is caused to pivot by a magnetic interaction force acting between the pair of permanent magnets and the coil.

2. A drive unit comprising:

(a) a swing shaft and a swinging body pivotally mounted on the swing shaft;

(b) a pair of permanent magnets mounted on the swinging body side by side as seen in the direction of the swing shaft;

(c) a yoke disposed extending across the pair of permanent magnets;

(d) a coil fixed in a position such that it magnetically interacts with the pair of permanent magnets; and (e) the yoke disposed on surfaces of the pair of permanent magnets and on the opposite side of the permanent magnets from the coil;

(f) wherein the swinging body is caused to pivot by a magnetic interaction force acting between the pair of permanent magnets and the coil.

3. A drive unit comprising:

(a) a swing shaft and a swinging body pivotally mounted on the swing shaft;

(b) a pair of permanent magnets mounted on the swinging body side by side as seen in the direction of the swing shaft;

(c) a magnetic body disposed in a position such that it magnetically interacts with the pair of permanent magnets, whereby the swinging body is forcibly caused to pivot to an initial position by a magnetic interaction force acting between the magnetic body and the pair of permanent magnets;

(d) a yoke disposed extending across the pair of permanent magnets;

(e) a coil fixed in a position such that it magnetically interacts with the pair of permanent magnets; and (f) the magnetic interaction force acting between the magnetic body and the pair of permanent magnets being smaller than the magnetic interaction force acting between the coil and the pair of permanent magnets;

(g) wherein the swinging body is caused to pivot by the magnetic interaction force acting between the pair of permanent magnets and the coil.

4. A drive unit comprising:

(a) a swing shaft and a swinging body pivotally mounted on the swing shaft;

(b) a pair of permanent magnets mounted on the swinging body side by side as seen in the direction of the swing shaft;

(c) a yoke disposed extending across the pair of permanent magnets;

(d) a coil fixed in a position such that it magnetically interacts with the pair of permanent magnets;

(e) a music signal generating means for generating a music signal; and (f) an exciting signal supplying means for supplying an exciting signal to the coil according to the music signal;

(g) wherein the swinging body is caused to pivot by a magnetic interaction force acting between the pair of permanent magnets and the excited coil.

5. A drive unit comprising:

(a) a swing shaft and a swinging body pivotally mounted on the swing shaft;

(b) a pair of permanent magnets mounted on the swinging body side by side as seen in the direction of the swing shaft;

(c) a magnetic body disposed in a position such that it magnetically interacts with the pair of permanent magnets whereby the swinging body is forcibly caused to pivot to an initial position by a magnetic interaction force acting between the magnetic body and the pair of permanent magnets;

(d) a yoke disposed extending across the pair of permanent magnets;

(e) a coil fixed in a position such that it magnetically interacts with the pair of permanent magnets;

(f) a music signal generating means for generating a music signal;

(g) an exciting signal supplying means for supplying an exciting signal to the coil according to the music signal; and (h) the magnetic interaction force acting between the magnetic body and the pair of permanent magnets being smaller than the magnetic interaction force acting between the excited coil and the pair of permanent magnets;

(i) wherein the swinging body is caused to pivot by the magnetic interaction force acting between the pair of permanent magnets and the excited coil.

6. A toy comprising:

(a) a base and a doll body;

(b) a swing shaft mounted in the doll body;

(c) a swinging body pivotally mounted on the swing shaft;

(d) a pair of permanent magnets mounted on the swinging body side by side as seen in the direction of the swing shaft;

(e) a yoke disposed extending across the pair of permanent magnets;

(f) a coil fixed in a position such that it magnetically interacts with the pair of permanent magnets;

(g) an arm of the doll body removably attached to the swinging body such that the arm swings in linkage with the swinging body;

(h) a tapper mounted on the arm; and (i) a sound producing body disposed in a position such that it is struck by the tappers;

(j) wherein the swinging body is caused to pivot by a magnetic interaction force acting between the pair of permanent magnets and the coil.

7. A toy comprising:

(a) a base and a doll body;

(b) a swing shaft mounted in the doll body;

(c) a swinging body pivotally mounted on the swing shaft;

(d) a pair of permanent magnets mounted on the swinging body side by side as seen in the direction of the swing shaft, (e) a magnetic body mounted in the doll body in a position such that it magnetically interacts with the pair of permanent magnets whereby the swinging body is forcibly caused to pivot to an initial position by a magnetic interaction force acting between the magnetic body and the pair of permanent magnets;

(f) a yoke disposed extending across the pair of permanent magnets;

(g) a coil mounted in the doll body in a position such that it magnetically interacts with the pair of permanent magnets;

(h) the magnetic interaction force acting between the magnetic body and the pair of permanent magnets being smaller than the magnetic interaction force acting between the coil and the pair of permanent magnets;

(i) an arm of the doll body removably attached to the swinging body such that the arm swings in linkage with the swinging body;

(j) a tapper mounted on the arm; and (k) a sound producing body disposed in a position such that it is struck by the tapper;

(l) wherein the swinging body is caused to pivot by the magnetic interaction force acting between the pair of permanent magnets and the coil.

8. A toy comprising:

(a) a base and a doll body;

(b) a swing shaft mounted in the doll body;

(c) a swinging body pivotally mounted on the swing shaft;

(d) a pair of permanent magnets mounted on the swinging body side by side as seen in the direction of the swing shaft;

(e) a yoke disposed extending across the pair of permanent magnets;

(f) a coil mounted in the doll body in a position such that it magnetically interacts with the pair of permanent magnets;

(g) the doll body having music signal generating means for generating a music signal;

(h) the doll body having exciting signal supplying means for supplying an exciting signal to the coil according to the music signal;

(i) an arm of the doll body removably attached to the swinging body such that the arm swings in linkage with the swinging body, (j) a tapper mounted on the arm; and (k) a sound producing body disposed in a position such that it is struck by the tapper;

(l) wherein the swinging body is caused to pivot by a magnetic interaction force acting between the pair of permanent magnets and the excited coil.

9. A toy comprising:

(a) a doll body;

(b) a swing shaft mounted in the doll body;

(c) a swinging body pivotally mounted on the swing shaft;

(d) a pair of permanent magnets mounted on the swinging body side by side as seen in the direction of the swing shaft;

(e) a magnetic body mounted in the doll body in a position such that it magnetically interacts with the pair of permanent magnets whereby the swinging body is forcibly caused to pivot to an initial position by a magnetic interaction force acting between the magnetic body and the pair of permanent magnets;

(f) a yoke disposed extending across the pair of permanent magnets;

(g) a coil mounted in the doll body in a position such that it magnetically interacts with the pair of permanent magnets;

(h) the doll body having music signal generating means for generating a music signal;

(i) the doll body having exciting signal supplying means for supplying an exciting signal to the coil according to the music signal;

(j) the magnetic interaction force acting between the magnetic body and the pair of permanent magnets being set smaller than the magnetic interaction force acting between the excited coil and the pair of permanent magnets;

(k) an arm of the doll body removably attached to the swinging body such that the arm swings in linkage with the swinging body; and (l) a tapper mounted on the arm;

(m) wherein the swinging body is caused to pivot by the magnetic interaction force acting between the pair of permanent magnets and the excited coil.

10. A toy comprising:

(a) a base and a doll body removably connected to the base;

(b) a swing shaft mounted in the doll body;

(c) a swinging body pivotally mounted on the swing shaft;

(d) a pair of permanent magnets mounted on the swinging body side by side as seen in the direction of the swing shaft;

(e) a yoke disposed extending across the pair of permanent magnets;

(f) a coil mounted in the doll body in a position such that it magnetically interacts with the pair of permanent magnets;

(g) the base having music signal generating means for generating a music signal;

(h) the base having exciting signal supplying means for supplying an exciting signal to the coil according to the music signal;

(i) wherein an arm of the doll body is removably attached to the swinging body and swings in linkage with the swinging body;

(j) a tapper mounted on the arm; and (k) a sound producing body disposed in a position such that it is struck by the tappers;

(l) wherein the swinging body is caused to pivot by a magnetic interaction force acting between the pair of permanent magnets and the excited coil.

11. A toy comprising:

(a) a base and a doll body removably connected to the base;

(b) a swing shaft mounted in the doll body;

(c) a swinging body pivotally mounted on the swing shaft;

(d) a pair of permanent magnets mounted on the swinging body side by side as seen in the direction of the swing shaft;

(e) a magnetic body mounted in the doll body in a position such that it magnetically interacts with the pair of permanent magnets whereby the swinging body is forcibly caused to pivot to an initial position by a magnetic interaction force acting between the magnetic body and the pair of permanent magnets;

(f) a yoke disposed extending across the pair of permanent magnets;

(g) a coil mounted in the doll body in a position such that it magnetically interacts with the pair of permanent magnets;

(h) the base having music signal generating means for generating a music signal;

(i) the base having exciting signal supplying means for supplying an exciting signal to the coil according to the music signal;

(j) the magnetic interaction force acting between the magnetic body and the pair of permanent magnets being smaller than the magnetic interaction force acting between the excited coil and the pair of permanent magnets;

(k) an arm of the doll body removably attached to the swinging body such that the arm swings in linkage with the swinging body;

(l) a tapper mounted on the arm; and (m) a sound producing body disposed in a position such that it is struck by the tappers;

(n) wherein the swinging body is caused to pivot by the magnetic interaction force acting between the pair of permanent magnets and the excited coil.

12. A toy comprising:

(a) a base and a doll body removably connected to the base;

(b) a swing shaft mounted in the doll body;

(c) a swinging body pivotally mounted on the swing shaft;

(d) a pair of permanent magnets mounted on the swinging body side by side as seen in the direction of the swing shaft;

(e) a yoke disposed extending across the pair of permanent magnets;

(f) a coil mounted in the doll body in a position such that it magnetically interacts with the pair of permanent magnets;

(g) the base having music signal generating means for generating a music signal;

(h) the base having exciting signal supplying means for supplying an exciting signal to the coil according to the music signal;

(i) an arm of the doll body removably attached to the swinging body such that the arm swings in linkage with the swinging body;

(j) a tapper mounted on the arm; and (k) the base disposed in a position such that it is struck by the tapper;

(i) wherein the swinging body is caused to pivot by a magnetic interaction force acting between the pair of permanent magnets and the excited coil.

13. A toy comprising:

(a) a base and a doll body removably connected to the base;

(b) a swing shaft mounted in the doll body;

(c) a swinging body pivotally mounted on the swing shaft;

(d) a pair of permanent magnets mounted on the swinging body side by side as seen in the direction of the swing shaft;

(e) a magnetic body mounted in the doll body in a position such that it magnetically interacts with the pair of permanent magnets whereby the swinging body is forcibly caused to pivot to an initial position by a magnetic interaction force acting between the magnetic body and the pair of permanent magnets;

(f) a yoke disposed extending across the pair of permanent magnets;

(g) a coil mounted in the doll body in a position such that it magnetically interacts with the pair of permanent magnets;

(h) the base having music signal generating means for generating a music signal;

(I) the base having exciting signal supplying means for supplying an exciting signal to the coil according to the music signal;

(j) the magnetic interaction force acting between the magnetic body and the pair of permanent magnets being smaller than the magnetic interaction force acting between the excited coil and the pair of permanent magnets;

(k) an arm of the doll body removably attached to the swinging body such that the arm swings in linkage with the swinging body;

(l) a tapper mounted on the arm; and (m) the base disposed in a position such that it is struck by the tapper;

(n) wherein the swinging body is caused to pivot by the magnetic interaction force acting between the pair of permanent magnets and the excited coil.

14. A drive unit comprising:

(a) a swing shaft and a swinging body pivotally mounted on the swing shaft;

(b) a pair of permanent magnets mounted on the swinging body side by side as seen in the direction of the swing shaft;

(c) a magnetic body mounted in a position such that it magnetically interacts with the pair of permanent magnets whereby the swinging body is forcibly caused to pivot to an initial position by a magnetic interaction force acting between the magnetic body and the pair of permanent magnets; and (d) a coil fixed in a position such that it magnetically interacts with the pair of permanent magnets;

(e) wherein the swinging body is caused to pivot by a magnetic interaction force acting between the pair of permanent magnets and the coil.

15. The drive unit of claim 14 further comprising a yoke disposed such that a magnetic path is formed between the pair of permanent magnets.

16. The drive unit of claim 15 wherein the yoke is disposed extending across the pair of permanent magnets.

17. A drive unit comprising:

(a) a swing shaft and a swinging body pivotally mounted on the swing shaft;

(b) a pair of permanent magnets mounted on the swinging body side by side as seen in the direction of the swing shaft:

(c) a yoke disposed such that a magnetic path is formed between the pair of permanent magnets; and (d) a coil fixed in a position such that it magnetically interacts with the pair of permanent magnets;

(e) wherein the swinging body is caused to pivot by a magnetic interaction force acting between the pair of permanent magnets and the coil.

18. A drive unit comprising:

(a) a swing shaft and a swinging body pivotally mounted on the swing shaft, (b) a pair of permanent magnets mounted on the swinging body side by side as seen in the direction of the swing shaft;

(c) a yoke disposed extending across the pair of permanent magnets; and (d) a coil fixed in a position such that it magnetically interacts with the pair of permanent magnets;

(e) wherein the swinging body is caused to pivot by a magnetic interaction force acting between the pair of permanent magnets and the coil.

* * * * *